US006907811B2

(12) United States Patent
White

(10) Patent No.: US 6,907,811 B2
(45) Date of Patent: Jun. 21, 2005

(54) BULLET RESISTANT BARRIER

(75) Inventor: Collins White, Syracue, NY (US)

(73) Assignee: Defenshield, Inc., Syracuse, NY (US)

( * ) Notice: Subject to any disclaimer, the term of this patent is extended or adjusted under 35 U.S.C. 154(b) by 0 days.

(21) Appl. No.: 10/243,508

(22) Filed: Sep. 14, 2002

(65) Prior Publication Data

US 2003/0167911 A1 Sep. 11, 2003

Related U.S. Application Data

(60) Provisional application No. 60/361,768, filed on Mar. 5, 2002.

(51) Int. Cl.[7] ..... F41H 5/14
(52) U.S. Cl. ..... 89/36.09; 89/36.02; 109/49.5
(58) Field of Search ..... 89/36.02, 36.04, 89/36.05, 36.07, 36.09, 36.15; 428/911; 109/49.5

(56) References Cited

U.S. PATENT DOCUMENTS

| | | | | | |
|---|---|---|---|---|---|
| 1,253,964 | A | * | 1/1918 | Hack | |
| 1,261,518 | A | * | 4/1918 | Hahre | |
| 1,274,721 | A | * | 8/1918 | Krzan | |
| 1,281,400 | A | * | 10/1918 | Larnell | |
| 3,590,685 | A | * | 7/1971 | Lane | |
| 3,994,243 | A | * | 11/1976 | Anders | 49/505 |
| 4,030,219 | A | * | 6/1977 | Donovan | 40/605 |
| 4,061,093 | A | * | 12/1977 | Carstens, Jr. et al. | 109/19 |
| 4,245,546 | A | * | 1/1981 | Chaires | 109/49.5 |
| 4,351,558 | A | * | 9/1982 | Mueller | 296/203.01 |
| 4,674,394 | A | * | 6/1987 | Martino | 89/36.05 |
| 4,781,101 | A | * | 11/1988 | Zevuluni et al. | 89/36.09 |
| 4,949,490 | A | * | 8/1990 | Miller | 40/605 |
| 5,438,908 | A | * | 8/1995 | Madden, Jr. | 89/36.08 |
| 5,703,316 | A | * | 12/1997 | Madden, Jr. | 89/36.08 |
| 5,857,730 | A | * | 1/1999 | Korpi et al. | 296/146.1 |
| 6,000,347 | A | * | 12/1999 | Madden, Jr. | 109/49.5 |
| 6,116,326 | A | * | 9/2000 | Domina et al. | 160/351 |
| 6,333,085 | B1 | * | 12/2001 | Emek | 428/34 |

FOREIGN PATENT DOCUMENTS

| | | | | |
|---|---|---|---|---|
| DE | 24 12 568 A1 | * | 9/1975 | 89/36.05 |
| FR | 2 607 238 | * | 5/1988 | |

* cited by examiner

*Primary Examiner*—Stephen M. Johnson
(74) *Attorney, Agent, or Firm*—George R. McGuire; Bond, Schoeneck & King PLLC

(57) ABSTRACT

A barrier comprising a base unit composed of a bullet resistant material and a transparent upper wall removably interconnected to the base unit and composed of a bullet resistant material. The base unit includes a front wall and two side walls extending from the front wall to provide protection to the front and sides of a person standing behind the barrier. A series of casters, preferably locking casters, are attached to the bottom edges of the side walls, and a pair of handles connected to each of the side walls permitting the barrier to be conveniently transported from one site to another.

5 Claims, 5 Drawing Sheets

18
48
46
42
40
24
38
28
26
22
20
26
16
34
28

18
48
10
42
5
42
46
32
5
44
38
34
28
36
30
26
16
28
1
26

BULLET RESISTANT BARRIER

CROSS-REFERENCE TO RELATED APPLICATION

The present application claims priority to U.S. Provisional Patent Application Ser. No. 60/361,768 filed Mar. 5, 2002.

BACKGROUND OF THE INVENTION

The present invention relates generally to bullet resistant barriers, and more particularly to such barriers that are portable.

There are many locations and situations where law enforcement/security personnel or others, such as workers in financial institutions, are regularly placed in harm's way. If the individuals are located in the same station everyday, that station may be equipped with bullet resistant properties to protect the occupant. However, in situations when the personnel must be mobile or move to various locations, it would be useful to have some bullet resistant barrier that could be moved with them. In addition, it would be useful for such a barrier to provide bullet resistant coverage to the personnel's entire body.

It is therefore a principal object and advantage of the present invention to provide a bullet resistant barrier that is movable.

It is a further object and advantage of the present invention to provide a bullet resistant barrier that provides protection to the entire body of an occupant.

It is an additional object and advantage of the present invention to provide a bullet resistant barrier that may be broken down for ease of transport.

Other objects and advantages of the present invention will in part be obvious, and in part appear hereinafter.

SUMMARY OF THE INVENTION

In accordance with the foregoing objects and advantages, the present invention contemplates a barrier comprising a base unit composed of a bullet resistant material, such as metal, plastic, ceramic or a composite material, and a transparent upper wall removably interconnected to the base unit and composed of a bullet resistant material, such as a bullet resistant plastic or glass. The base unit includes a front wall and two side walls extending from the front wall to provide protection to the front and sides of a person standing behind the barrier. A series of casters, preferably locking casters, are attached to the bottom edges of the side walls, and a pair of handles are connected to each of the side walls permitting the barrier to be conveniently transported from one site to another.

A bracket assembly comprising first and second upstanding channel members interconnected by an S-shaped double channel member extending transversely there between serves to removably interconnect the upper wall to the base unit. The S-shaped member hooks over the upper edge of the front wall with its lower channel being positioned to receive the bottom edge of the upper wall. The two upstanding channel members are positioned at opposite ends of the S-shaped member and engage the opposite side edges of the upper wall. The upper wall may be slid into or out of engagement with this bracket assembly, thereby facilitating convenient break-down of the barrier.

BRIEF DESCRIPTION OF THE DRAWINGS

The present invention will be more fully understood and appreciated by reading the following Detailed Description in conjunction with the accompanying drawings, in which.

DETAILED DESCRIPTION

Figure 1:
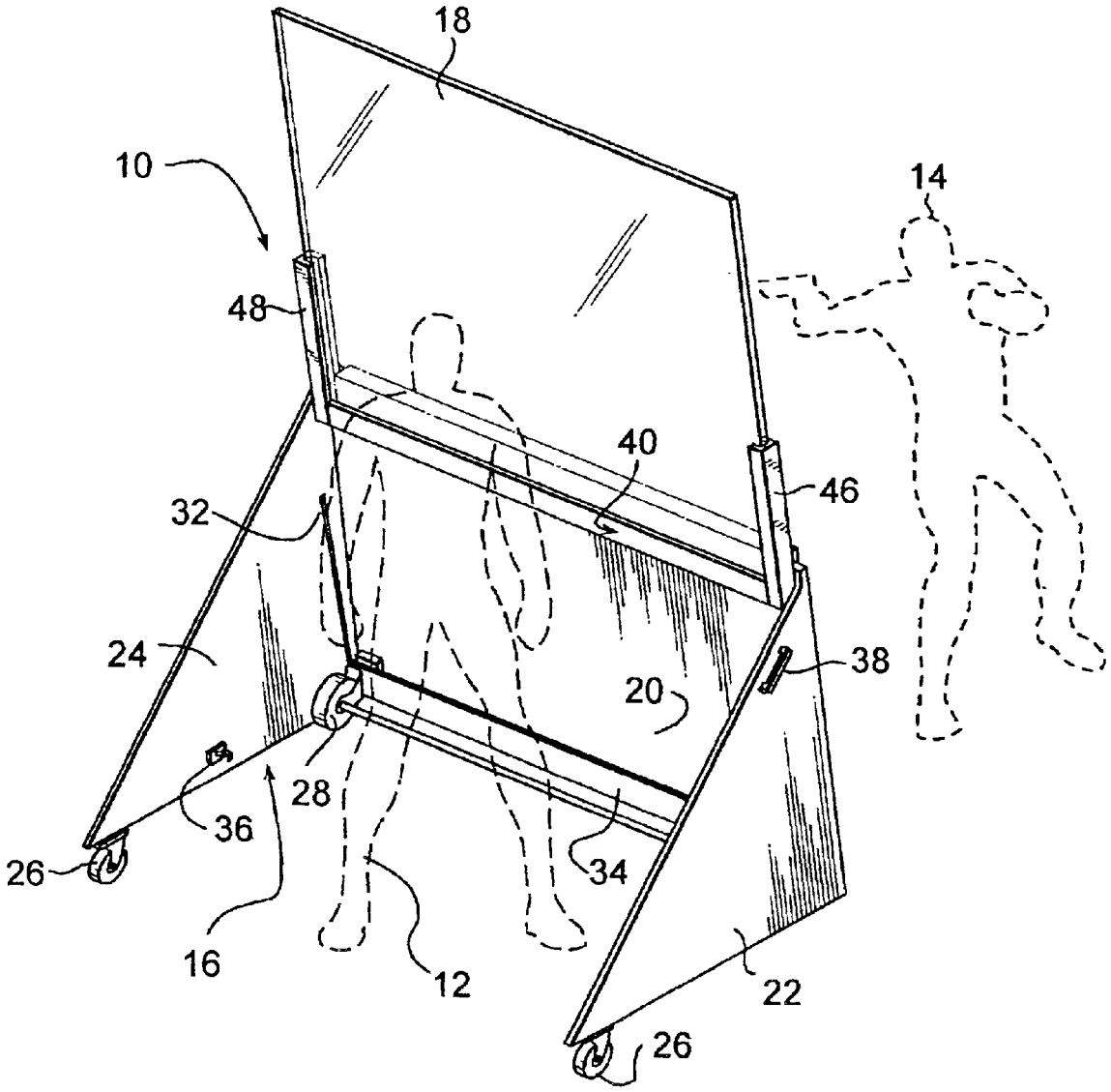
FIG. 1 is a perspective view illustrating use of the present invention.
Figure 2:
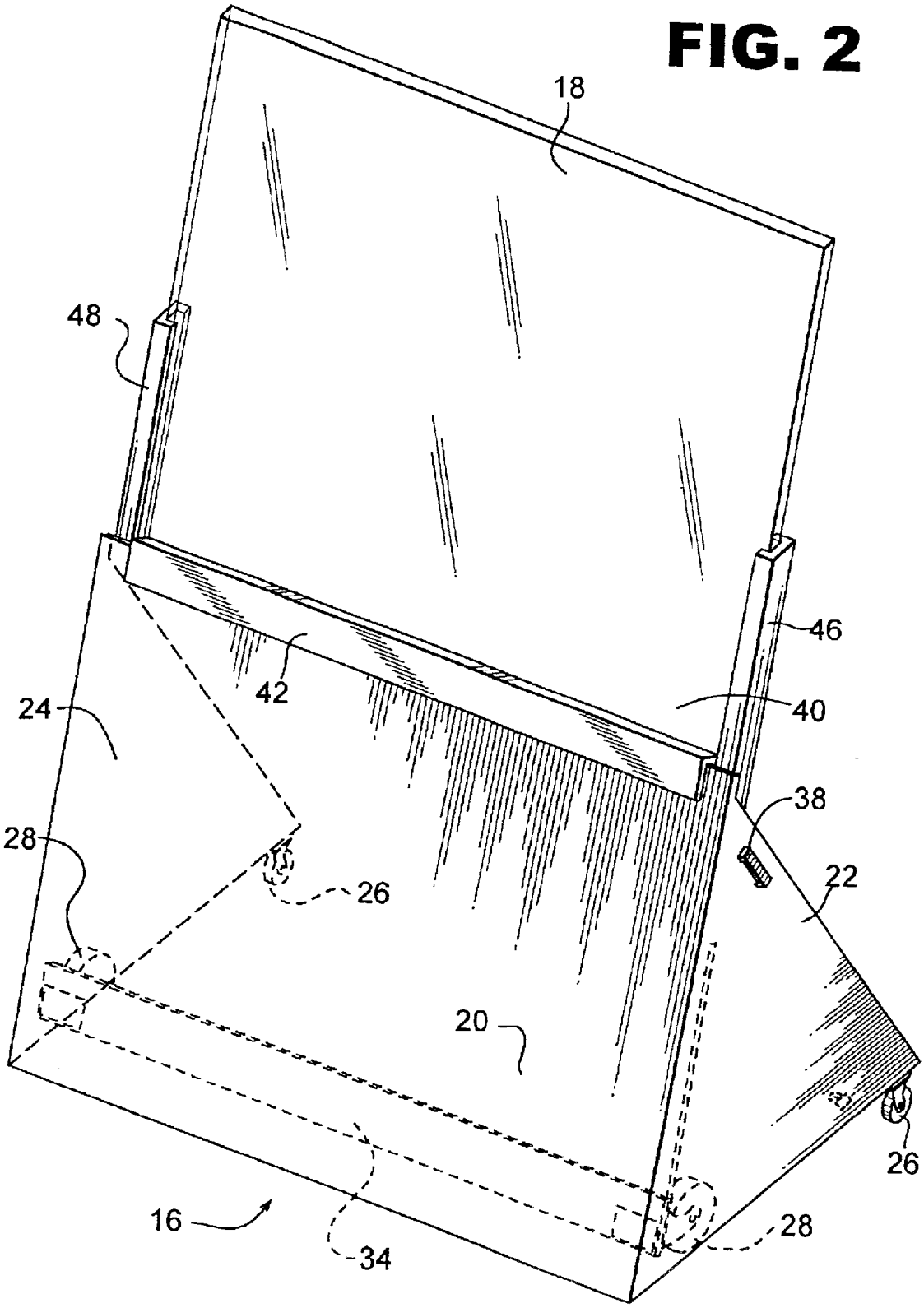
FIG. 2 is a front perspective view of the present invention.
Figure 3:
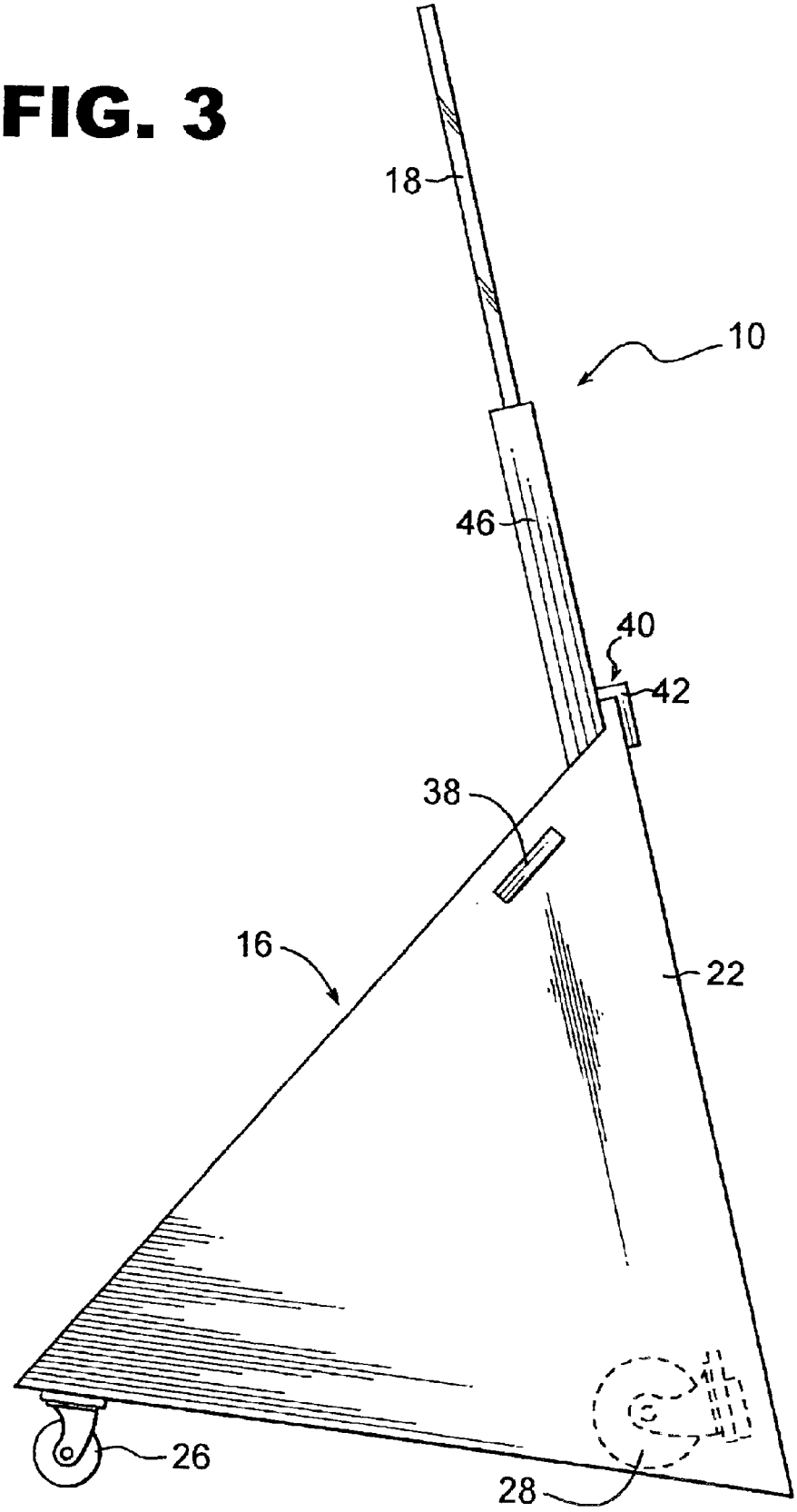
FIG. 3 is a side elevation view of the present invention.
Figure 4:
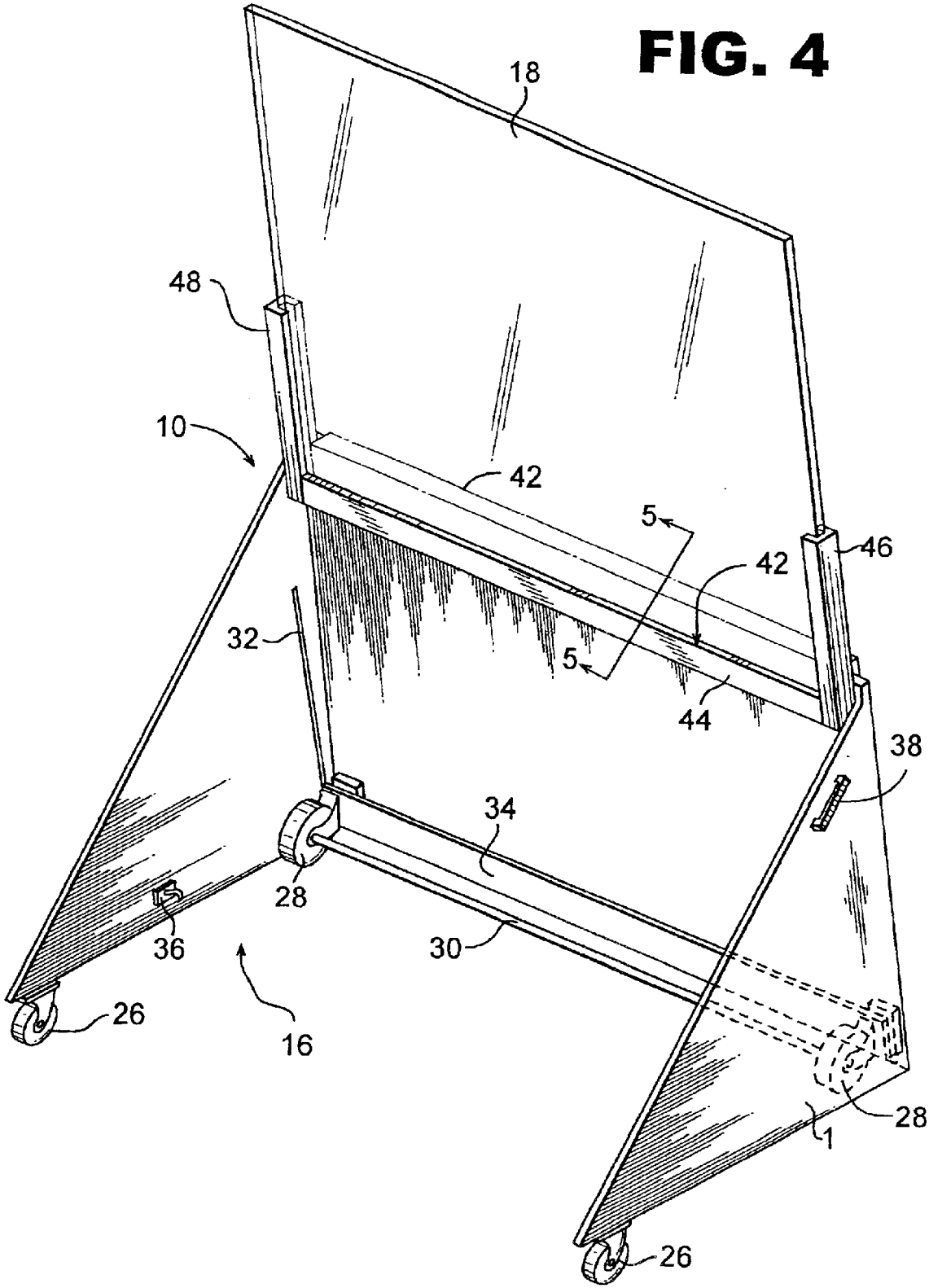
FIG. 4 is a rear perspective view of the present invention.

Referring now to the drawings, wherein like reference numerals refer to like parts throughout, there is seen in FIG. 1 a barrier device designated generally by reference numeral 10, designed to protect personnel (a "target") 12 from the gunshots of a perpetrator (a "source") 14. Barrier 10 generally comprises a base unit 16 and a transparent, upper wall 18 removably interconnected to the base unit, both of which are composed of bullet resistant materials (for instance, base unit 16 may be composed of metal, plastic, ceramic or a composite material, and upper wall 18 may be composed of Bullet resisting Plastic or Glass).

Base unit 16 comprises a front wall 20 and two side walls 22, 24 which extend perpendicularly rearward from opposing side edges of front wall 20. A first pair of casters 26 are connected to the bottom edges of side walls 22, 24, and a second pair of casters 28 interconnected to one another by an axle 30 are pivotally attached to front wall 20 in order to be moveable into or out of engagement with the ground. A rod 32 and locking bar 34 may be used by "target" 12 to lock/unlock casters 28 and pivotally move them into or out of engagement with the ground (rod 32 may snap into bracket 36 mounted to the interior surface of side wall 24 to lock casters 28 in engaging relation with the ground). To assist in moving barrier 10, handles 38 are mounted to the exterior surfaces of side walls 22, 24 for grasping by the person moving the unit.

Figure 5:
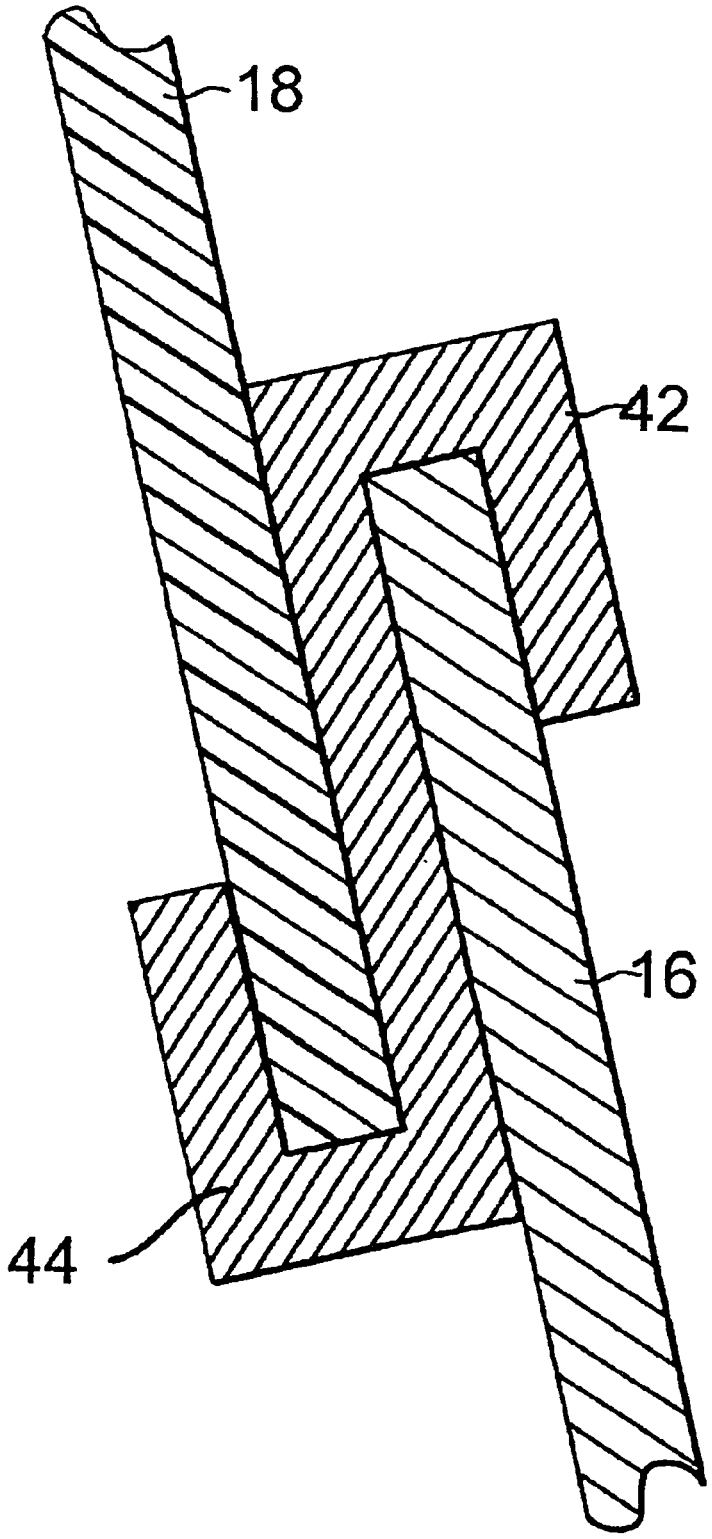
FIG. 5 is a cross-sectional view taken along line 5—5 of FIG. 4.

A bracket assembly is provided to interconnect upper wall 18 to base unit 16. The bracket assembly comprises an S-shaped member 40 that extends along a longitudinal axis and includes and upper channel member 42 that engages the upper edge of front wall 20, and a lower channel member 44 in which the bottom edge of upper wall 18 is positioned (alternatively, this member could simply comprise lower channel 44 attached to or integrally formed with front wall 20), as illustrated in FIG. 5. A pair of upstanding channel members 46, 48 are attached to (or could be integral with) base unit 16 and positioned at opposite end of S-shaped member 42, and extend along respective longitudinal axes that are parallel to one a other and essentially perpendicular to the axis along which S-shaped member 40 extends. The opposing side edges of upper wall 18 engage channel members 46, 48, respectively, thereby slidably and removably interconnecting upper wall 18 to base unit 16.

What is claimed is:

1. A barrier comprising:

a. a base unit composed of a first bullet resistant material comprising a first wall and second and third walls extending from and held in spaced relation by said first wall;

b. a bracket attached to said base unit;

c. an upper wall composed of a second bullet resistant material removably positioned in said bracket;

d. first and second casters attached to said base unit; and e. third and fourth casters interconnected to pivotally movable with respect to said base unit, whereby said third and fourth casters are movable into and out of engagement with the ground.

2. The barrier of claim 1, wherein said wall is transparent.

3. The barrier of claim 1, wherein said first bullet resistant material is metal, plastic, ceramic or a composite material.

4. The barrier of claim 1, wherein said upper wall is composed of a bullet resistant plastic or glass.

5. The barrier of claim 1, further comprising first and second handles attached to said second and third walls, respectively, of said base unit.

* * * * *

UNITED STATES PATENT AND TRADEMARK OFFICE

CERTIFICATE OF CORRECTION

PATENT NO. : 6,907,811 B2
APPLICATION NO. : 10/243508
DATED : June 21, 2005
INVENTOR(S) : Collins White It is certified that error appears in the above-identified patent and that said Letters Patent is hereby corrected as shown below:

Column 2:
Claim 1, line 10, insert --and-- between “to” and “pivotally”.

Column 3:
Claim 2, line 1, insert --upper-- between “said” and “wall”.

Signed and Sealed this

Twenty-fifth Day of December, 2007

JON W. DUDAS
*Director of the United States Patent and Trademark Office*